US006725469B2

(12) United States Patent
Coates

(10) Patent No.: US 6,725,469 B2
(45) Date of Patent: Apr. 27, 2004

(54) SWIMMING POOL COPING

(76) Inventor: Paul Coates, 60 James St., Burford, ON (CA), N0E 1A0

( * ) Notice: Subject to any disclaimer, the term of this patent is extended or adjusted under 35 U.S.C. 154(b) by 0 days.

(21) Appl. No.: 10/173,394

(22) Filed: Jun. 18, 2002

(65) Prior Publication Data

US 2003/0009822 A1 Jan. 16, 2003

Related U.S. Application Data

(60) Provisional application No. 60/304,449, filed on Jul. 12, 2001.

(51) Int. Cl.[7] ..... E04H 4/00

(52) U.S. Cl. ..... 4/506; 4/496; 52/300; 52/716.2

(58) Field of Search ..... 4/506, 496; 52/300, 52/102, 169.7, 716.2

(56) References Cited

U.S. PATENT DOCUMENTS

| | | | | | |
|---|---|---|---|---|---|
| 4,370,839 | A | * | 2/1983 | Blakeway | 52/169.7 |
| 4,457,119 | A | * | 7/1984 | Dahowski | 52/300 |
| 4,601,073 | A | | 7/1986 | Methot | 4/506 |
| 4,603,521 | A | * | 8/1986 | Engelhart | 52/102 |
| 4,864,960 | A | | 9/1989 | Sansoucy | 114/345 |
| 4,901,492 | A | | 2/1990 | Coates | 52/300 |
| 5,107,551 | A | * | 4/1992 | Weir et al. | 4/496 |
| 5,170,517 | A | | 12/1992 | Stegmeier | 4/496 |
| 5,680,730 | A | | 10/1997 | Epple | 52/28 |
| D397,231 | S | | 8/1998 | Saxer | D25/119 |
| 5,903,933 | A | | 5/1999 | Stegmeier | 4/506 |
| 5,915,848 | A | | 6/1999 | Deason | 4/496 |

* cited by examiner

*Primary Examiner*—Gregory L. Huson
*Assistant Examiner*—Huyen Le

(57) ABSTRACT

The present invention is coping for use in a swimming pool, said coping oriented along a longitudinal direction, and comprises a web disposed along said longitudinal direction, including a means for attaching said web to a side wall of a pool; wherein said web including a strip section integrally part of said web; a strip section being preferably irreversibly removable by shearing off a longitudinal strip section from said cap web for irreversibly removing said strip section from a facia of said web to expose an accessory slot defined behind said removed strip section, wherein said accessory slot adapted for attaching accessories to said coping.

18 Claims, 8 Drawing Sheets

72
62
71
47
64
60
70
34
100
90
91
96

SWIMMING POOL COPING

This application claims the benefit of provisional application No. 60/304,449, filed Jul. 12, 2001.

FIELD OF THE INVENTION

This invention relates to swimming pool construction and more particularly to a coping structure which is used to cap the upper edge of the wall of the swimming pool.

BACKGROUND OF THE INVENTION

Conventionally swimming pool copings may be made of extruded materials, such as aluminum or plastic. They are positioned usually at the juncture of the vertical swimming pool walls and the horizontal deck which circumscribes the swimming pool and forms the transition piece there between. Copings may be used to retain in place the upper peripheral bead of a swimming pool liner.

The coping is one of the most important elements in a swimming pool structure, particularly in inground or onground swimming pool construction. It is essential to have a reliable and durable coping and important also that the coping be easily secured and useful for a variety of functions including a reliable attachment means for the vinyl liner in pools that use a liner and to attach other accessories such as pool covers and lighting. The coping is subject to much use and frequent abuse because it is invariably stepped on, jumped on and often abused by equipment carried in or near the pool by those using the pool and often bumped by equipment used in servicing the pool. Because of its prominent position just above and surrounding the pool surface, the coping is alway in view by those in the vicinity of the pool and therefore, should present a neat and undistorted appearance.

THE PRIOR ART

It is known that a wide variety of swimming pool copings are in use, including stone, tile, concrete, metal and plastic, each of which is secured to the deck and/or the wall of the pool by a variety of mechanisms, including mechanical attachment, adhesive or being retained with poured concrete. Illustrated prior art copings for example, are those disclosed in U.S. Pat. Nos. 4,901,492, 5,680,730, 5,170,517.

While prior art copings including those disclosed in the above patents have been available in rigid, semi-rigid and flexible materials such copings have been either too cumbersome and have required substantial work to install on the pool on the one hand or in the case of the lighter weight construction copings of the prior and had a tendency to distort and present an unsightly appearance. In addition, all of the prior art coping systems, require installation in sections with seams along the coping. There is no system currently available which can be formed out of one uniform continuous piece of coping around the entire periphery of the pool. In addition, there are currently demands for installing lighting around the coping of the pool in the form of fibre optic lighting which normally is housed within a groove within the coping. The difficulty with lighting is that some pools are installed with lighting and other pools are installed without lighting, thereby giving rise to the need for coping systems which incorporate both options.

There is accordingly a need for coping which is readily installed which affords definite advantageous of versatility which presents an undistorted appearance and promotes maintenance of the swimming pool and which supplies a convenient means for the attachment of a plurality of protective and functional accessories for the pool.

SUMMARY OF THE INVENTION

The present invention a coping for use in a swimming pool, said coping oriented along a longitudinal direction, said coping comprises:

(a) a web disposed along said longitudinal direction, including a means for attaching said web to a side wall of a pool;

(b) wherein said web including a strip section integrally part of said web; and, (c) a means for irreversibly removing said strip section from a facia of said web to expose an accessory slot defined behind said removed strip section, wherein said accessory slot adapted for attaching accessories to said coping.

Preferably wherein said strip section preferably irreversibly removable by shearing off a longitudinal strip section from said web.

Preferably wherein said facia and strip section preferably made from a flexible plastic material.

Preferably said web including a base including a means for connecting said coping to a sidewall of a pool.

Preferably wherein said web including a first slot oriented along said longitudinal direction and for receiving and retaining a pool liner bead therein.

Preferably wherein said web including a second slot oriented along said longitudinal direction, and for receiving and retaining other pool accessories therein.

An alternate embodiment to the present invention includes a cap for a coping having a longitudinal direction for use in a swimming pool, said cap of the type for co-operatively attaching to a backer, said cap comprises;

(a) a flexible cap web being flexible enough to be installed in one continuous piece onto a backer and around a periphery of a pool.

Preferably wherein:

(a) said cap web including a strip section integrally part of said cap web and a means for irreversibly removing said strip section from a facia of said cap web to expose an accessory slot defined behind said removed strip section, wherein said accessory slot adapted for attaching accessories to said coping.

Preferably wherein said strip section being preferably irreversibly removable by shearing off a longitudinal strip section from said cap web.

Preferably wherein said cap and strip section preferably made from a flexible plastic material.

An alternate embodiment to the present invention includes in combination a coping for use with a swimming pool including a cap and a backer, said coping comprising:

(a) a cap for co-operatively attaching to a backer for supporting and retaining said cap in place; and (b) a flexible cap web being flexible enough to be installed in one continuous piece onto said backer and around a periphery of a pool.

Preferably wherein:

a) said cap web including a strip section integrally part of said cap web and a means for irreversibly removing said strip section from a facia of said cap web to expose an accessory slot defined behind said removed strip section, wherein said accessory slot adapted for attaching accessories to said coping.

Preferably wherein said strip section being preferably irreversibly removable by shearing off a longitudinal strip section from said cap web.

Preferably wherein said cap and strip section preferably made from a flexible plastic material.

BRIEF DESCRIPTION OF THE DRAWINGS

The invention will now be described by way of example only, with references to the following drawings in which.

DETAILED DESCRIPTION OF THE PREFERRED EMBODIMENT

Figure 19:
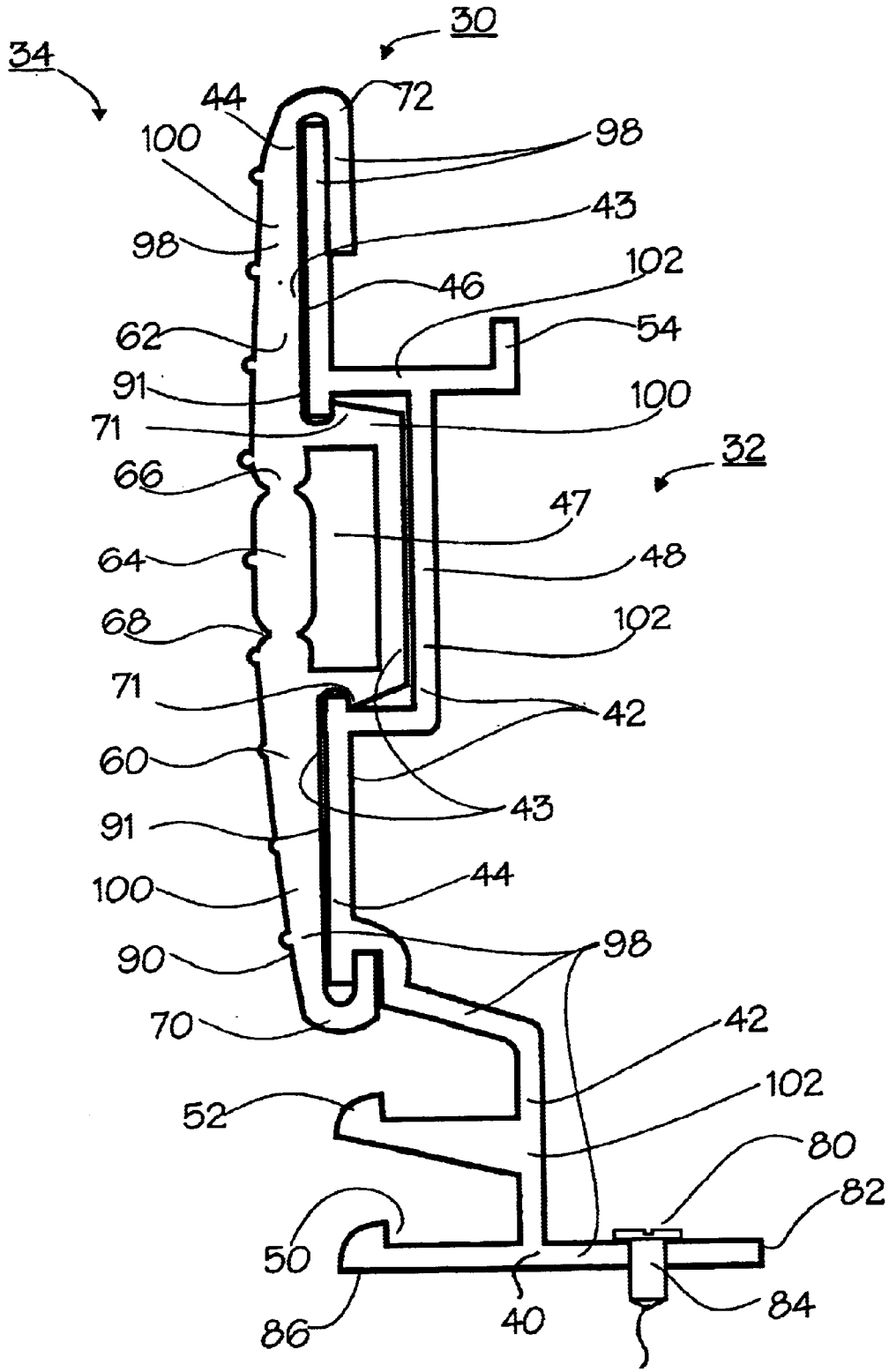
FIG. 19 is an enlarged cross-section view of the cap together with the backer with the strip section in place.

The present invention a coping which is shown generally as 30 to be used at the juncture of a vertical swimming pool wall and a horizontal deck circumscribes the swimming pool and forms the transition piece there between. Coping 30 includes the following major components, namely backer 32, upon which cap 34 is mounted wherein preferably backer 32 is manufactured from a metallic ductile material such as aluminum and cap 34 is preferably manufactured from a flexible plastic material such as PVC. It should be understood from the outset that it is possible to produce coping 30 as a single unit, wherein backer 32 and cap 34 are integrally the part of one piece having one integral web 98, either extruded in plastic or in aluminum, having a different cross-sectional profile as shown in FIG. 19.

Backer 32 includes a base 40 having a base bottom surface 86, base flange 82, an anchor aperture 84, which initially is an indentation 83 for guiding a self taping screw wherein in a fastener 80 preferably a self taping screw fastener passes there through for anchoring said backer 32 onto a swimming pool vertical wall. Backer 32 includes a wall section 42 integrally connected to base 40 defining backer web 102 including a first slot 50 a second slot 52, lower support 44, slot support 48, an anchor flange 54, an upper support 46, all of which are integrally connected and normally made of ductile extruded aluminum alloys. The front side of wall section 42 of backer 32 defines a wall facia 43 for receiving of backside 91 of cap 34 thereon.

In the case that coping 30 is made one integral piece, meaning backer 32 and cap 34 are cohesively made from one extruded section, then coping 30 is defined by a single web 98 and as previously described above can be extruded out of metal or plastic materials, and or be made of a composite extension.

Preferably coping 30 is constructed in two pieces, namely backer 32 which is made out of a stiffer metallic and/or plastic material and cap 34 which is mounted onto backer 32 made of a more flexible, preferably plastic and/or PVC material. In this manner, backer 32 provides the structural, strength and retaining support for the more flexible cap 34 which is mounted onto backer 32.

Cap 34 includes cap web 100 including a hook bottom end 70, a lower section 60, a strip section 64, with a lower shear section 68 and an upper shear section 66, an upper section 62 and a hooked top end 72. A backside 91 of cap 34 comes into contact with wall fascia 43 of wall section 42, of backer 32.

The front side or exposed portion of cap 34 is shown as fascia 90 which is the visible portion of cap 34 once the construction of the pool has been completed.

Figures 1, 2, 3, 4:
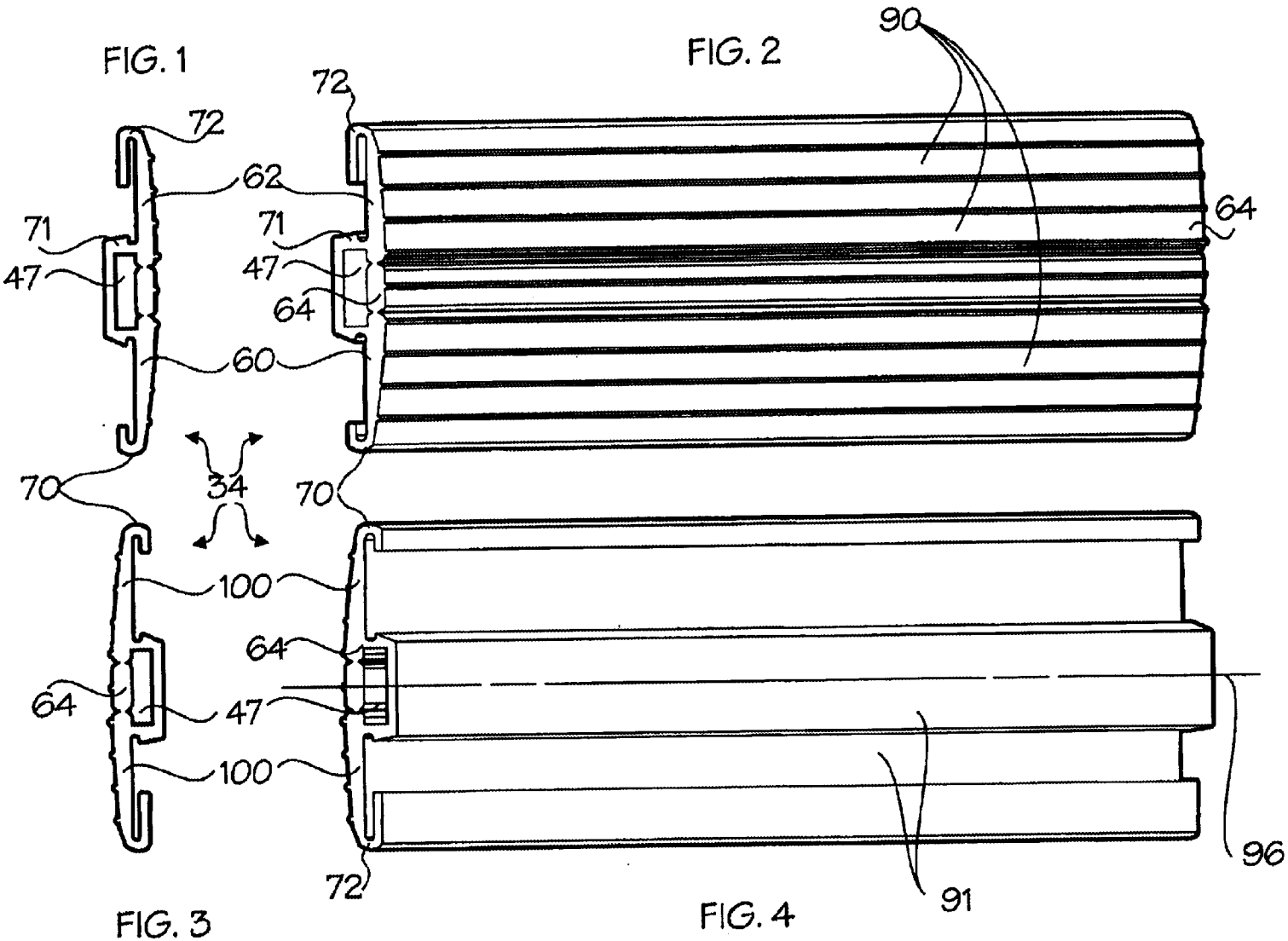
FIG. 1 is a cross-sectional view of a cap.
FIG. 2 is a front plan elevational schematic view of the cap.
FIG. 3 is a cross-sectional view of the cap.
FIG. 4 is a back plan elevational schematic view of the cap.
Figure 5:
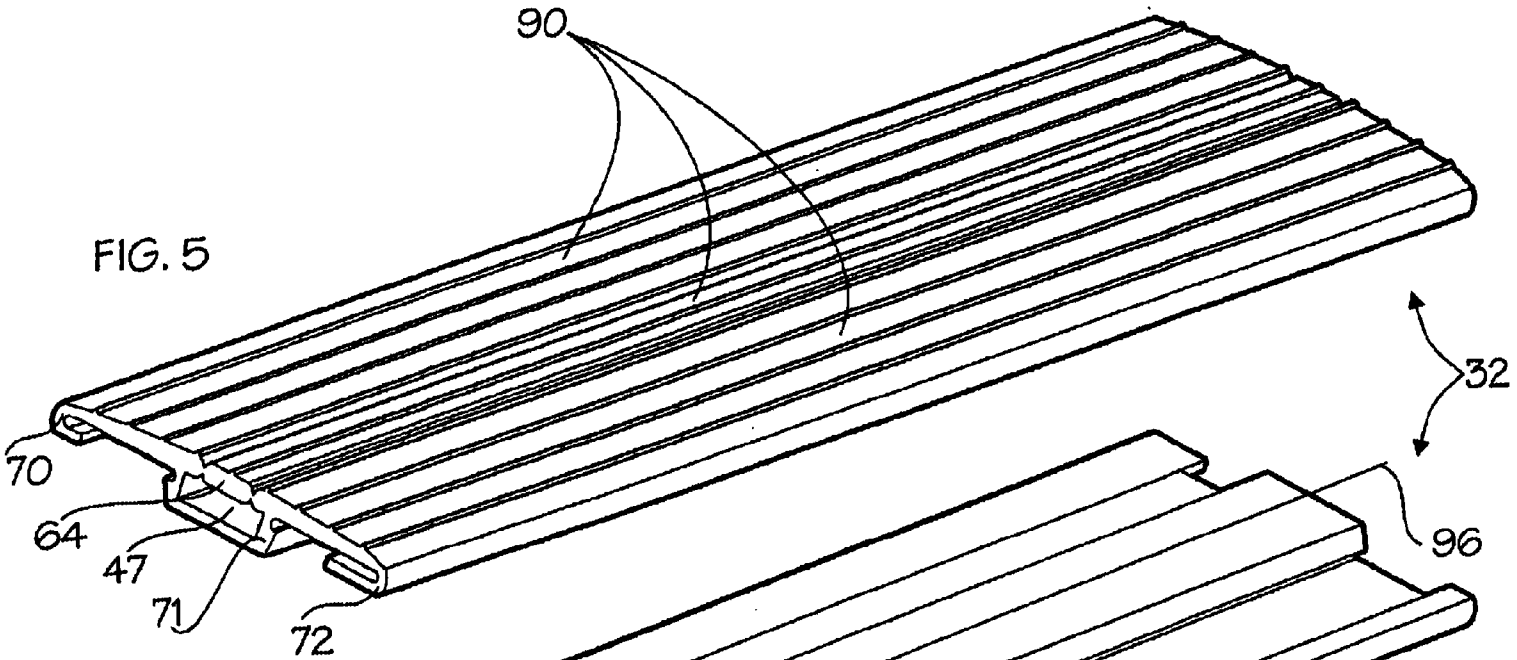
FIG. 5 is a top perspective schematic view of the cap.
Figure 6:
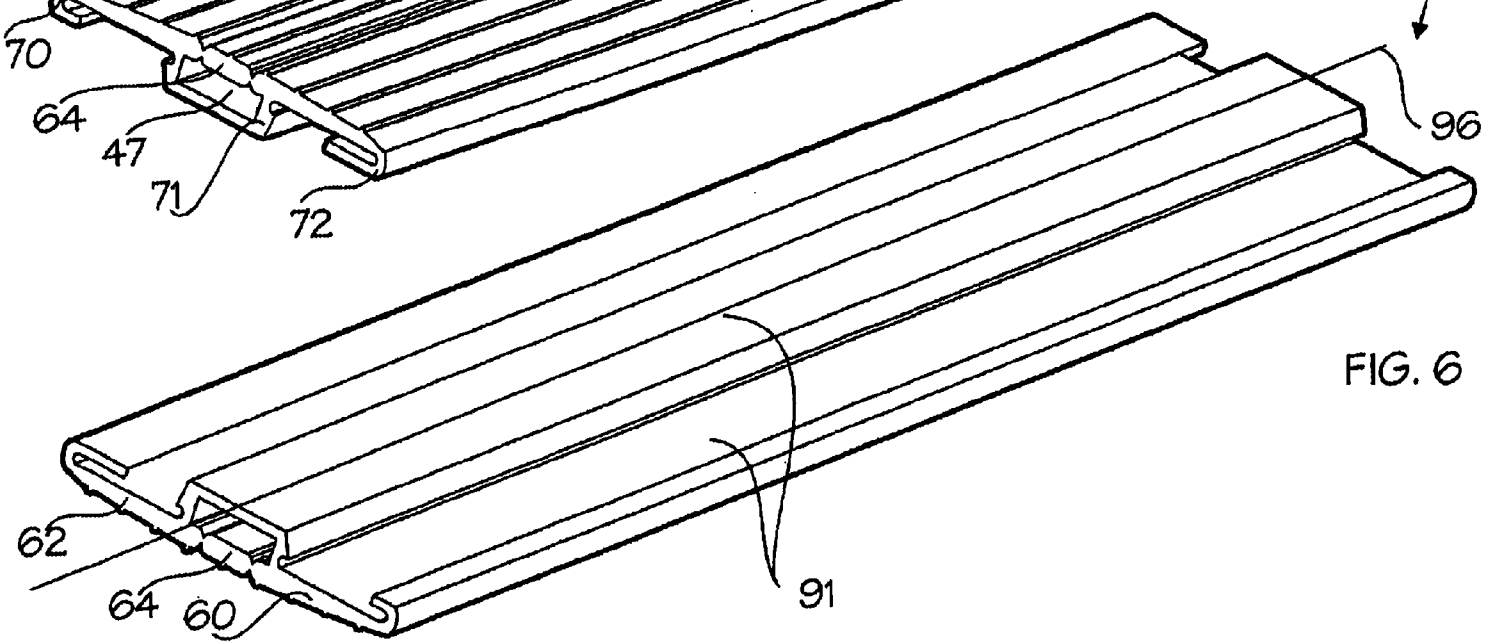
FIG. 6 is a bottom schematic perspective view of the cap.
Figures 7, 8:
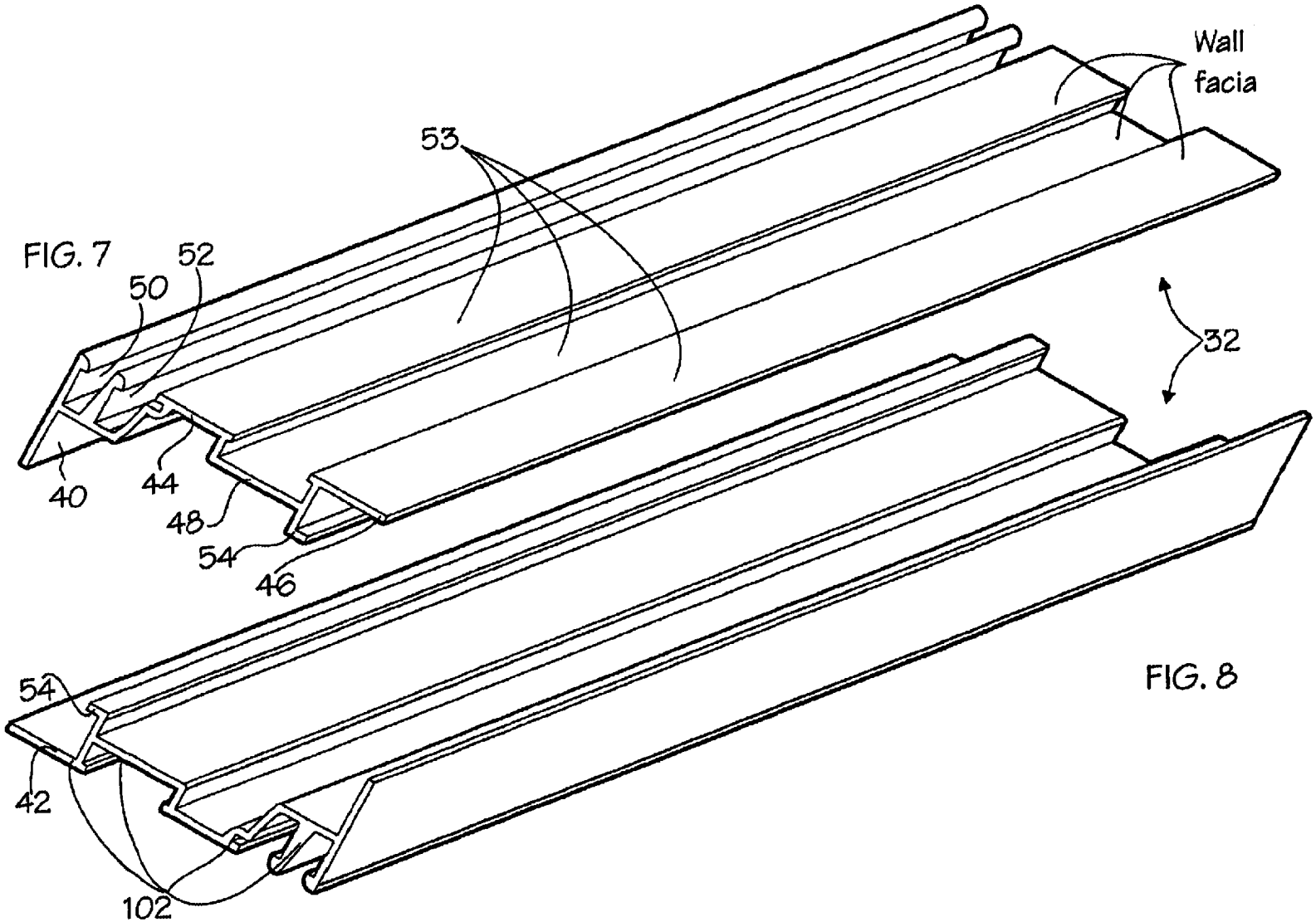
FIG. 7 is a top perspective view of the backer.
FIG. 8 is a bottom perspective view of the backer.
Figure 10:
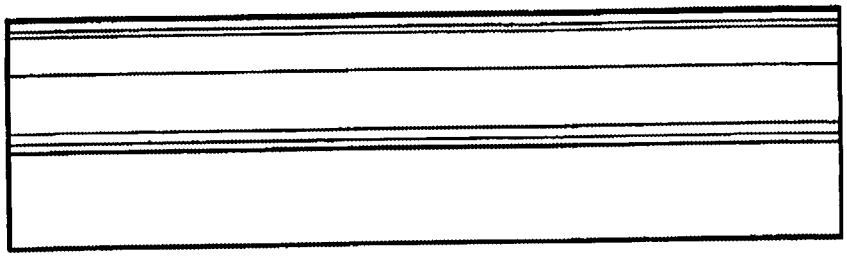
FIG. 10 is a back plan elevational view of the backer.
Figure 9:
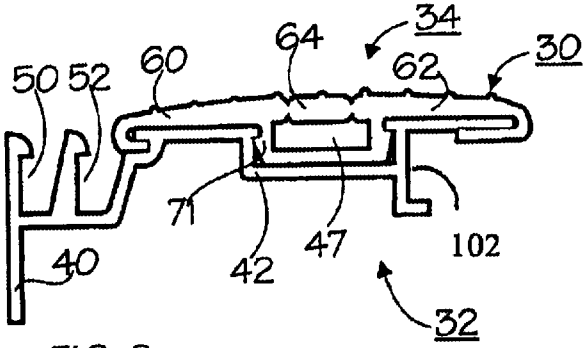
FIG. 9 is a cross-sectional view of the cap together with the backer.
Figure 11:
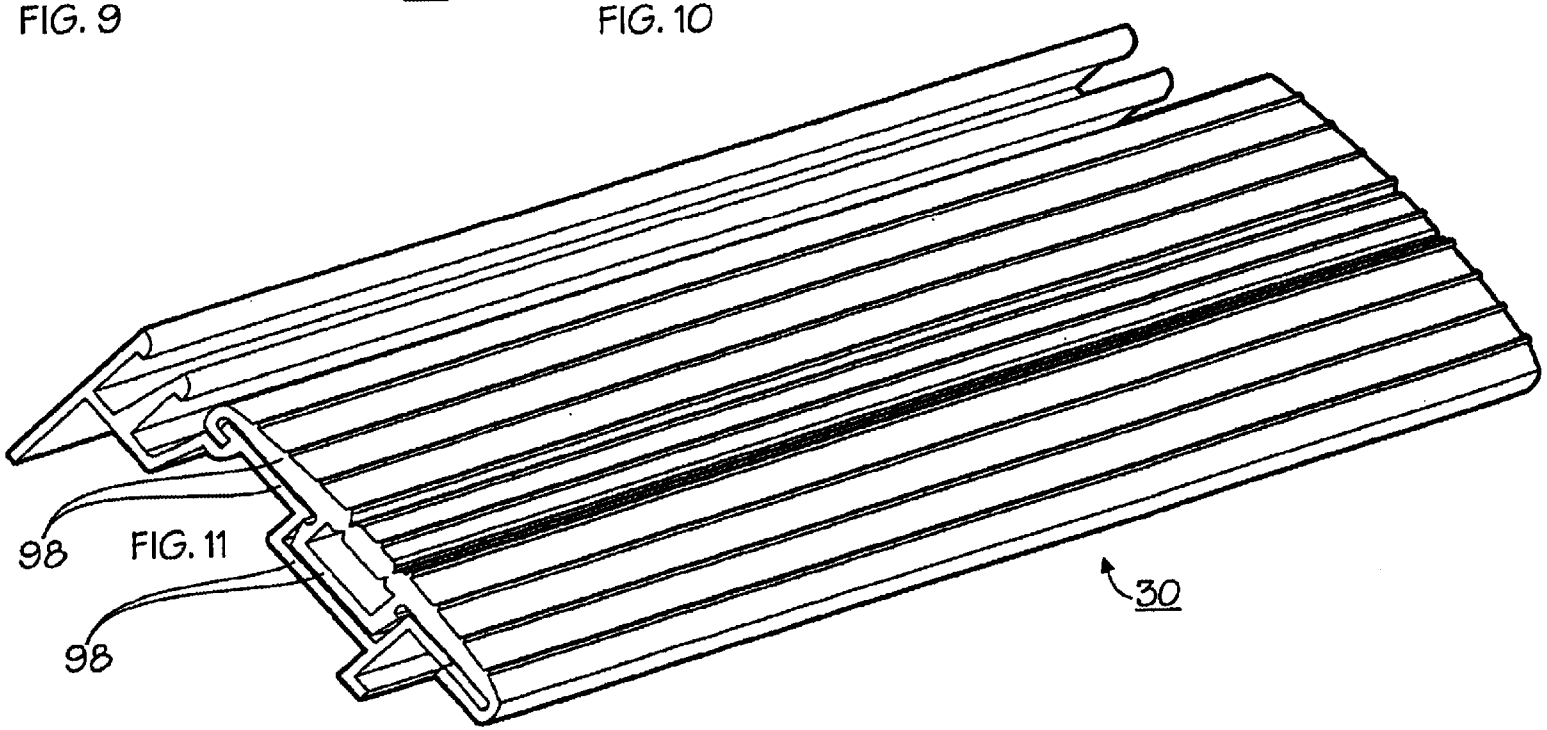
FIG. 11 is a top perspective schematic view of the cap and backer.
Figures 12, 13, 14:
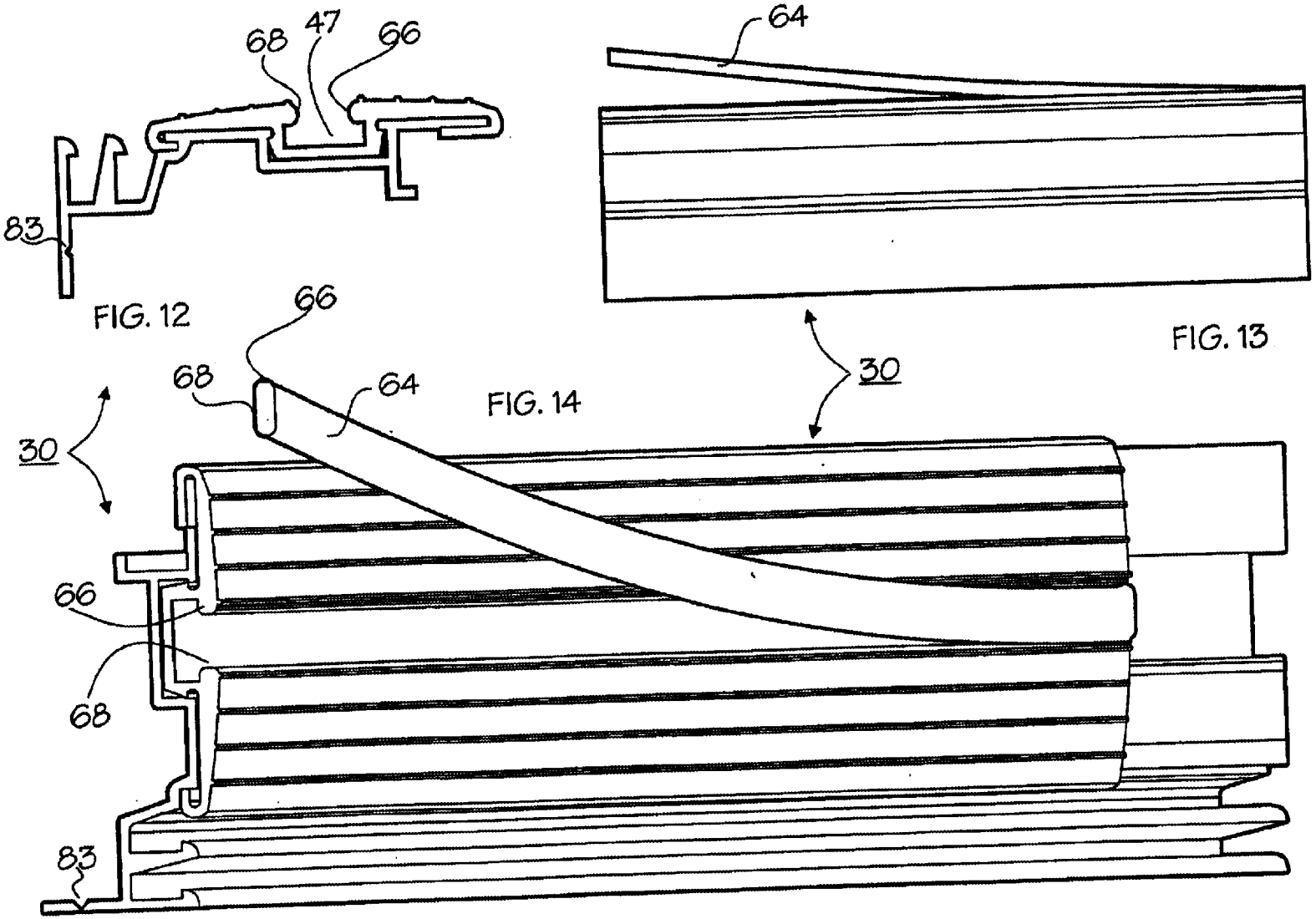
FIG. 12 is a cross-sectional view of the cap and backer showing the strip section irreversibly sheared away exposing the accessory slot.
FIG. 13 is a top plan view showing the strip section partially sheared away.
FIG. 14 is a schematic side perspective view showing in schematic fashion the shearing away of the strip portion, by pulling off the strip section.

Cap 34 includes strip section 64 integrally part of cap web 100 which can be left in situ as shown in FIG. 19 and/or can be sheared along upper shear section 66 and lower shear section 68 by pulling away on one end of strip section 64, thereby shearing off strip section 64 from cab web 100 and exposing a accessory slot 47 defined by cap 34 once strip section 64 has been removed as shown in FIG. 12, 13 and 14.

First slot 50 is usually used for fastening the bead of pool liner to coping 30 and second slot 52 is often used for fastening a pool cover in a releasable fashion, or other pool accessories.

With strip section 64 removed, accessory slot 47 is exposed and normally is used to house fibre optic lighting within accessory slot 47 which extends around the outer periphery of the swimming pool.

As already mentioned, cap 34 is normally made of a flexible material such as PVC having an approximate durometer of 93 and being flexible enough such that hook top end 72 can be installed around a rigid upper support 46 as shown in FIG. 19 and hook bottom end 70 can be installed around rigid lower support 44 as shown in FIG. 19 and tabs 71 of cap 34 snap into position in behind upper support 46 and lower support 44 of backer 32. Cap 34 is flexible enough to install onto backer 30 without special tools and without damaging or breaking hooked ends 70 and 72. Wherein cap 34 is preferably and normally produced from an extrusion process forming indefinitely long continuous lengths of capping 34.

In Use

Figure 15:
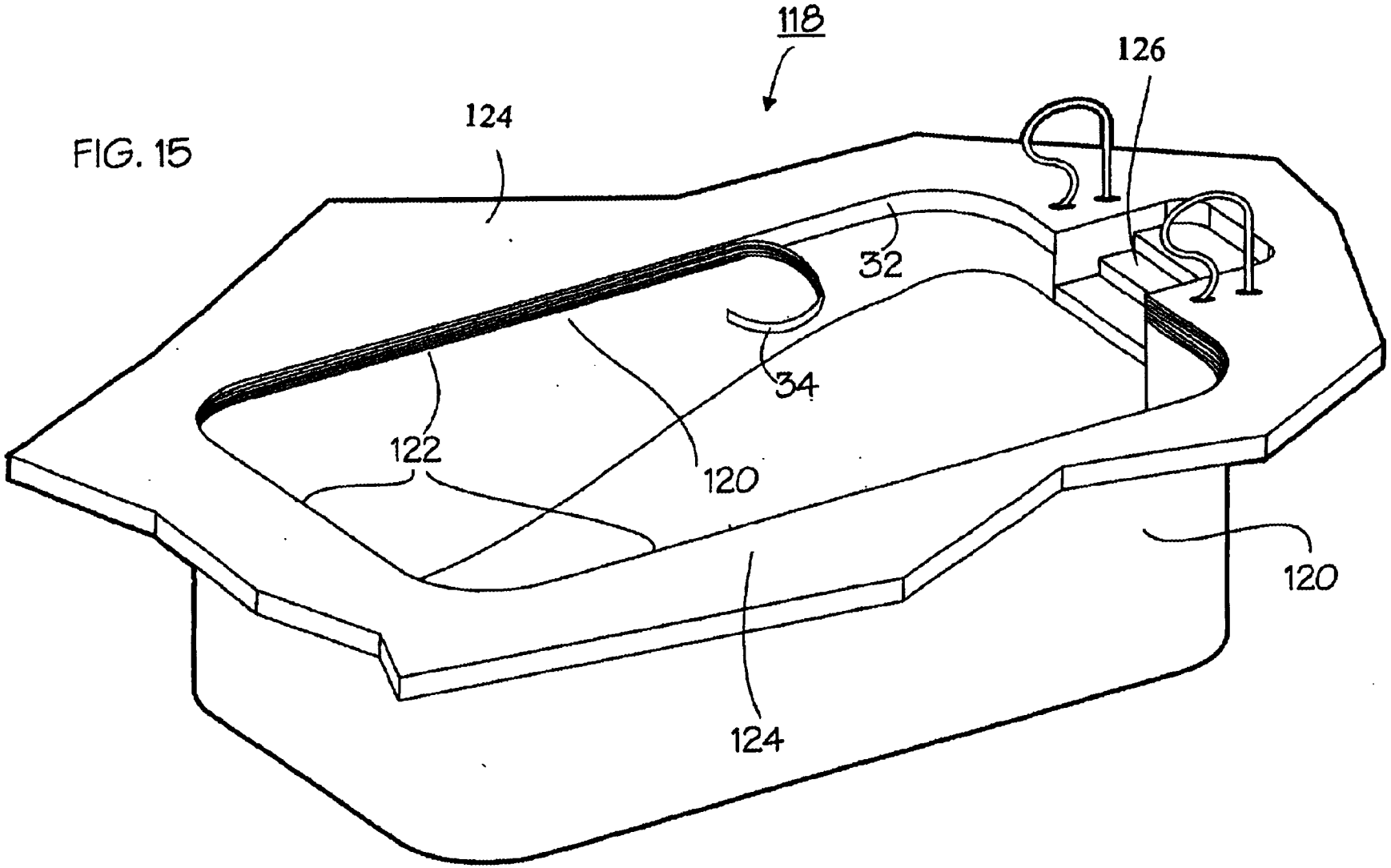
FIG. 15 is a schematic view of an in ground swimming pool showing in schematic fashion how the coping is installed together with the cap and the backer around the outer periphery of a pool.

Referring now to all the Figures and in particular referring to FIGS. 15 to 19, base 40 of backer 32 is mounted onto vertical wall 120 of a swimming pool 118. Fasteners 80 tap through indentation 83 thereby creating anchor aperture 84 which fastens backer 32 onto vertical wall 120. Vertical wall 120 can be of various construction, including metal frame work, concrete and/or other materials. Backer 32 being relatively inflexible is normally cut and installed in sections along pool periphery 122. Backer 32 is ductile and enough to be able to be bent around corners which may exist around the outside pool periphery 122 of a swimming pool 118. Prior to installing decking 124 which often is poured concrete around the outer periphery 122 of swimming pool 118, cap 34 is installed onto backer 32 as shown in FIG. 15. It is possible to use one continuous piece of capping 34 around the entire pool periphery 122 thereby ensuring a seamless installation of one continues piece of capping 34 around the entire pool periphery 122 which butt up on each side to stairs 126 as shown in FIG. 15. With backer 32 and cap 34 in place, decking 124 is normally installed by pouring concrete around the outer pool periphery 122 as shown in FIG. 15.

Cap 34 has strip section 64 in situ and one can select whether or not to remove strip section 64 by shearing and removing it from cap 34. Shearing strip section 64 along upper shear section 66 and lower shear section 68 exposes accessory slot 47 in behind strip section 64. Strip section 64 is irreversibly removed in this matter since the material from cap 34 is sheared away from itself, thereby leaving an open accessory slot 47. There is no reason why accessory slot 47 could not later on be covered with some other material other than strip section 64 which has been removed.

Figures 16, 17, 18:
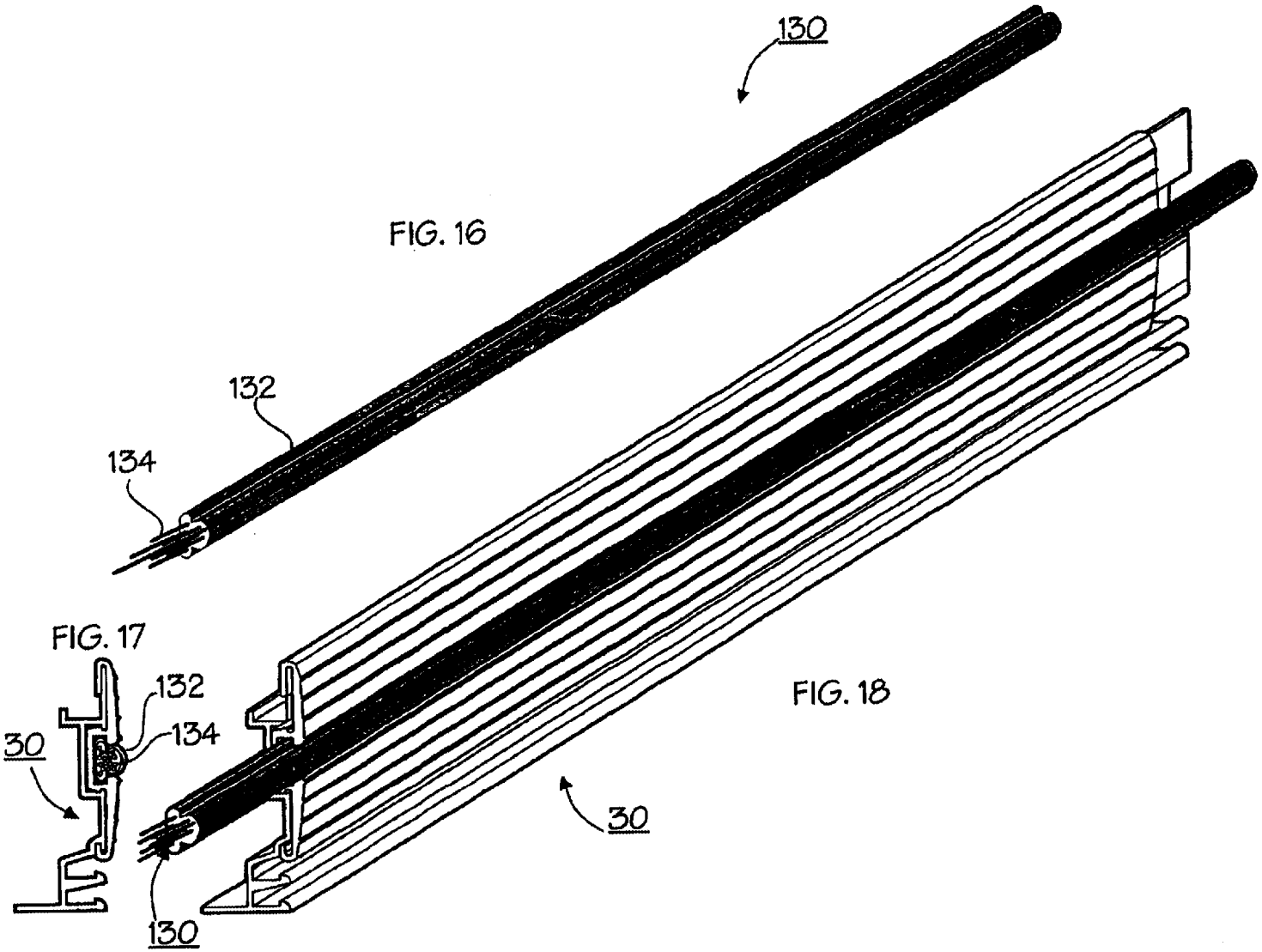
FIG. 16 is a schematic perspective front view of a fibre optic lighting strip.
FIG. 17 is a cross-sectional view of the cap and the backer together with the fibre optic strip located in the slot.
FIG. 18 is a front side schematic view of the cap and the backer together with the fibre optic strip located in the slot.

Referring now to FIGS. 16, 17 and 18, preferably with strip section 64 removed from cap 34, fibre optic lighting 130 having optic fibres 134 housed with in a fibre optic sheath 132 are fed into accessory slot 47 and extends around the entire periphery 122 of swimming pool 118. In this manner, the user can decide whether or not to install fibre optic lighting and should the user not wish to have fibre optic lighting, strip section 64 remains in place integrally part of cap 34 providing a water proof, water tight seal. Should the user decide to install a fibre optic lighting or some other accessory at any time, strip section 64 could be removed shearably and fibre optic lighting thereafter installed in the exposed accessory slot 47.

It should be apparent to persons skilled in the arts that various modifications and adaptation of this structure described above are possible without departure from the spirit of the invention the scope of which defined in the appended claim.

I claim:

1. A coping for use in a swimming pool, said coping oriented along a longitudinal direction, said coping comprising:

(a) a web disposed along said longitudinal direction, including a means for attaching said web to a side wall of a pool;

(b) wherein said web including a strip section integrally part of said web; and, (c) a means for irreversibly removing said strip section by operatively adapting said strip section for forcibly shearing the strip section away from a facia of said web to expose an accessory slot defined behind said removed strip section, wherein said accessory slot adapted for attaching accessories to said coping.

2. The coping claimed in claim 1, wherein said irreversibly removing means including a longitudinal strip section defined in said web, said strip section dimensioned such that it shears away along parallel and spaced apart longitudinally oriented upper and lower shear sections defined in said web, such that a uniform strip section is sheared away from said web by forcibly urging and thereby shearing said strip section away from said web.

3. The coping claimed in claim 2, wherein said upper and lower shear sections including longitudinally oriented linear portions of the web dimensioned substantially thinner than the adjacent material to ensure that shearing of the strip section occurs along said upper and lower shear sections.

4. The coping claimed in claim 1, wherein said web and strip section preferably made from a flexible plastic material.

5. The coping claimed in claim 1, wherein said attaching means including a base intergrally part of said coping web for fastening said coping to a side wall of a pool.

6. The coping claimed in claim 1 wherein said web including a first slot oriented along said longitudinal direction and for receiving and retaining a pool liner bead therein.

7. The coping claimed in claim 1 wherein said web including a second slot oriented along said longitudinal direction, and for receiving and retaining other pool accessories therein.

8. A cap for a coping, oriented along a longitudinal direction for use in a swimming pool, said cap of the type for co-operatively attaching to a backer, said cap comprising;

(a) a flexible cap web being flexible enough to be installed in one continuous piece onto a backer and around a periphery of a pool;

(b) wherein said cap web including a strip section integrally part of said cap web; and, (c) a means for irreversibly removing said strip section by operatively adapting said strip section for forcibly shearing the strip section away from a facia of said cap web to expose an accessory slot defined behind said removed strip section, wherein said accessory slot adapted for attaching accessories to said coping.

9. The cap claimed in claim 7, wherein:

said irreversibly removing means including a longitudinal strip section defined in said cap web, and said strip section dimensioned such that it shears away along parallel and spaced apart longitudinally oriented upper and lower shear sections defined in said cap web, such that a uniform strip section is sheared away from said cap web by forcibly urging and thereby shearing said strip section away from said cap web.

10. The cap claimed in claim 8, wherein said cap and strip section preferably made from a flexible plastic material.

11. The cap claimed in claim 9, wherein said upper and lower shear sections including longitudinally oriented linear portions of the cap web dimensioned substantially thinner than the adjacent material to ensure that shearing of the strip section occurs along said upper and lower shear sections.

12. In combination a coping for use with a swimming pool including a cap and a backer, said coping comprising:

(a) a cap for co-operatively attaching to a backer for supporting and retaining said cap in place; and (b) a flexible cap web being flexible enough to be installed in one continuous piece onto said backer and around a periphery of a pool;

(c) wherein said cap web including a strip section integrally part of said cap web; and, (d) a means for irreversibly removing said strip section by operatively adapting said strip section for forcibly shearing the strip section away from a facia of said cap web to expose an accessory slot defined behind said removed strip section, wherein said accessory slot adapted for attaching accessories to said coping.

13. The combination claimed in claim 12, wherein:

said irreversibly removing means including a longitudinal strip section defined in said cap web, said section dimensioned such that shears away long parallel and spaced apart longitudinally oriented upper and lower shear sections defined in said cap web, such that a uniform strip section is sheared away from said cap web by forcibly urging and thereby shearing said strip section away from said cap web.

14. The combination claimed in claim 13, wherein said backer including a base portion for fastening said backer around a side wall of a pool.

15. The combination claimed in claim 13, wherein said cap and strip section preferably made from a flexible plastic material.

16. The combination claimed in claim 13 wherein said web including a first slot oriented along said longitudinal direction and for receiving and retaining a pool liner bead therein.

17. The combination claimed in claim 16 wherein said web including a second slot oriented along said longitudinal direction, and for receiving and retaining other pool accessories therein.

18. The combination claimed in claim 13, wherein said upper and lower shear sections including longitudinally oriented linear portions of the cap web dimensioned substantially thinner than the adjacent material to ensure that shearing of the strip section occurs along said upper and lower shear sections.

* * * * *